US006805350B1

(12) United States Patent
Wu

(10) Patent No.: US 6,805,350 B1
(45) Date of Patent: Oct. 19, 2004

(54) BALL WITH A JIGSAW COVER

(76) Inventor: Yu Feng Wu, 12A, No. 133, An Ho Rd., Taichung (TW)

( * ) Notice: Subject to any disclaimer, the term of this patent is extended or adjusted under 35 U.S.C. 154(b) by 0 days.

(21) Appl. No.: 10/429,846

(22) Filed: May 6, 2003

(51) Int. Cl.[7] ..... A63F 9/12
(52) U.S. Cl. ..... 273/157 R; 273/156
(58) Field of Search ..... 273/157 R, 153 R, 273/156, 160; 434/131, 132, 134, 137, 133; D21/478, 479

(56) References Cited

U.S. PATENT DOCUMENTS 3,618,955 A * 11/1971 Barnes ..... 273/157 R
3,691,704 A * 9/1972 Novak ..... 273/157 R
3,851,884 A * 12/1974 Mylier ..... 273/157 R
4,180,008 A * 12/1979 Nakamoto ..... 116/170
4,865,323 A * 9/1989 Heusinkveld ..... 273/153 S
5,441,261 A * 8/1995 Margolis et al. ..... 273/157 R
5,842,697 A * 12/1998 Scott et al. ..... 273/157 R

* cited by examiner

*Primary Examiner*—Steven Wong
(74) *Attorney, Agent, or Firm*—Rosenberg, Klein & Lee

(57) ABSTRACT

A ball with a jigsaw cover includes a hollow core having a first hemisphere and a second hemisphere fixedly connected to each other to form a complete spheroid. Multiple puzzle pieces are detachably adhered to an outer periphery of the hollow core and each has a curvature equal to that of the hollow core for completely covering the outer periphery of the hollow core. Each puzzle piece defines at least one concave portion and forms at least one convex portion laterally extending from each of the multiple puzzle pieces. Each concave portion receives a corresponding convex portion of an adjacent puzzle piece such that the multiple puzzle pieces are connected to one another.

4 Claims, 7 Drawing Sheets

BALL WITH A JIGSAW COVER

BACKGROUND OF THE INVENTION

1. Field of the Invention

The present invention relates to a ball, and more particularly to a ball with a jigsaw cover that can provide a jigsaw puzzle.

2. Description of Related Art

A conventional earth jigsaw puzzle in accordance with the prior art shown in FIG. 7, which is designed as a globe and comprises a core (50) and multiple puzzle pieces (51) being adjacent to one another and attached to an outer periphery of the core (50) to form a globe. For stand the globe, the conventional jigsaw puzzle further comprises a stand (60) provided to supporting the globe formed by the conventional jigsaw puzzle. The stand (60) includes a base (61) abutting a supporting surface and a rod (62) upwardly extending from the base (61). The rod (62) has a free end secured in the globe near the South Pole of the globe for supporting the globe.

The above globe is formed by a jigsaw puzzle, but only a choice of design of a jigsaw puzzle and cannot provide any function of a ball. A globe usually is used as a teaching aids or an ornament, and stored in a cabinet or put on a desk cannot be used as a ball. Consequently, the using range of the above globe is narrow and may be boring to a younger child.

The present invention has arisen to mitigate and/or obviate the disadvantages of the conventional earth jigsaw puzzle.

SUMMARY OF THE INVENTION

The main objective of the present invention is to provide an improved ball that has a jigsaw cover for providing amusements of jigsaw puzzle and functions of training logic ability.

To achieve the objective, a ball with a jigsaw cover in accordance with the present invention comprises a hollow core having a first hemisphere and a second hemisphere fixedly connected to each other to form a complete spheroid. Multiple puzzle pieces are detachably adhered to an outer periphery of the hollow core and each has a curvature equal to that of the hollow core for completely covering the outer periphery of the hollow core. Each puzzle piece defines at least one concave portion and forms at least one convex portion laterally extending from each of the multiple puzzle pieces. Each concave portion receives a corresponding convex portion of an adjacent puzzle piece such that the multiple puzzle pieces are connected to one another.

Further benefits and advantages of the present invention will become apparent after a careful reading of the detailed description with appropriate reference to the accompanying drawings.

DETAILED DESCRIPTION OF THE INVENTION

Figure 1:
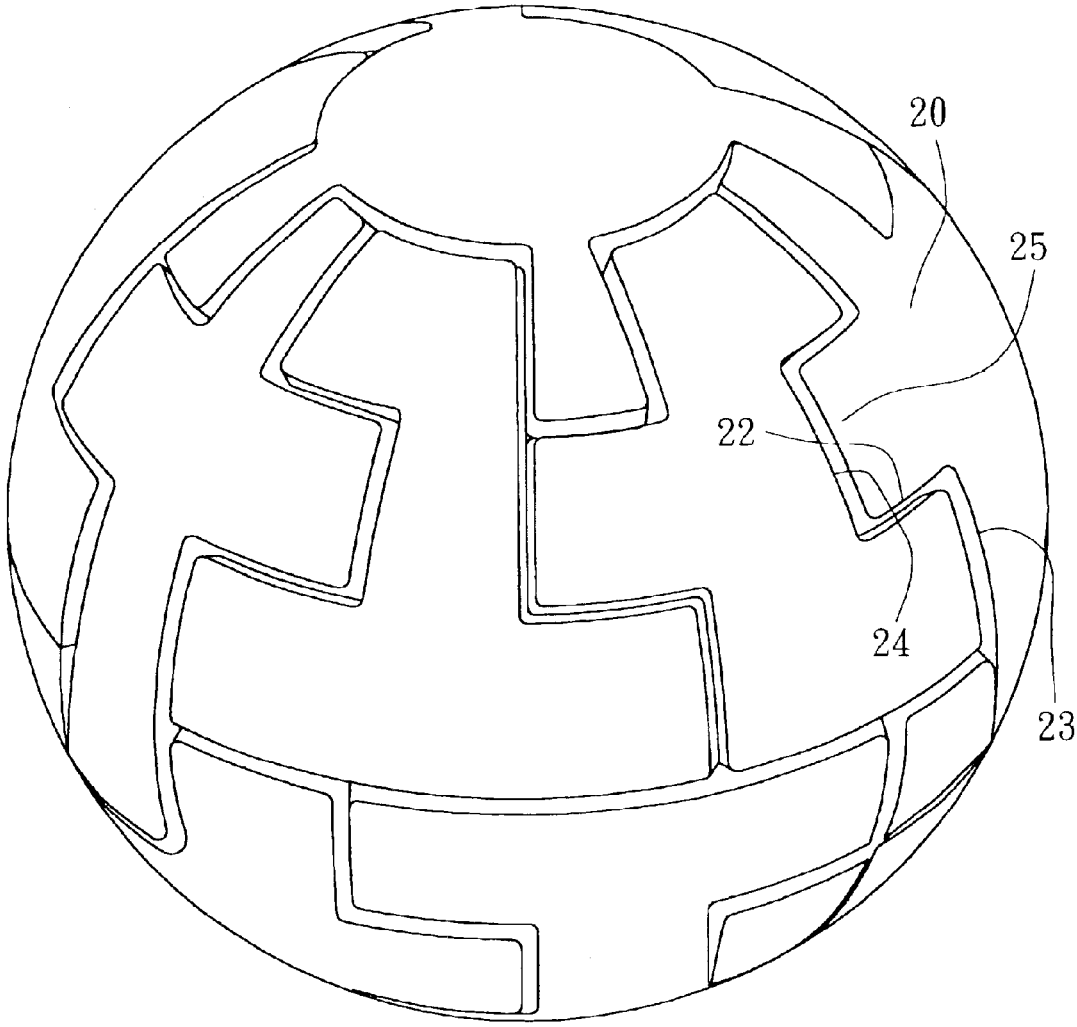
FIG. 1 is a perspective view of a ball with a jigsaw cover in accordance with the present invention.
Figure 2:
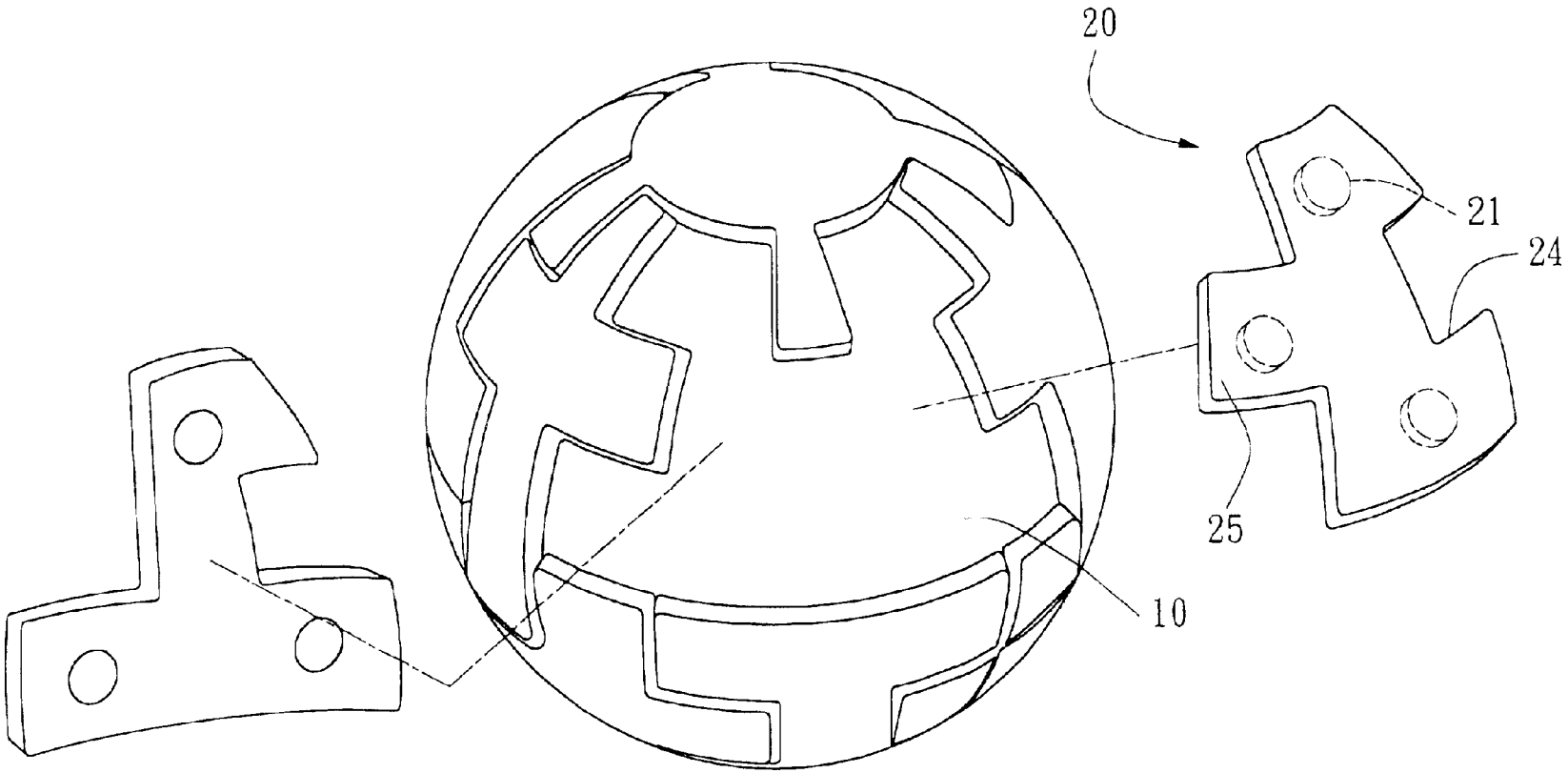
FIG. 2 is a partially exploded perspective view of the ball with a jigsaw cover in FIG. 1.
Figure 3:
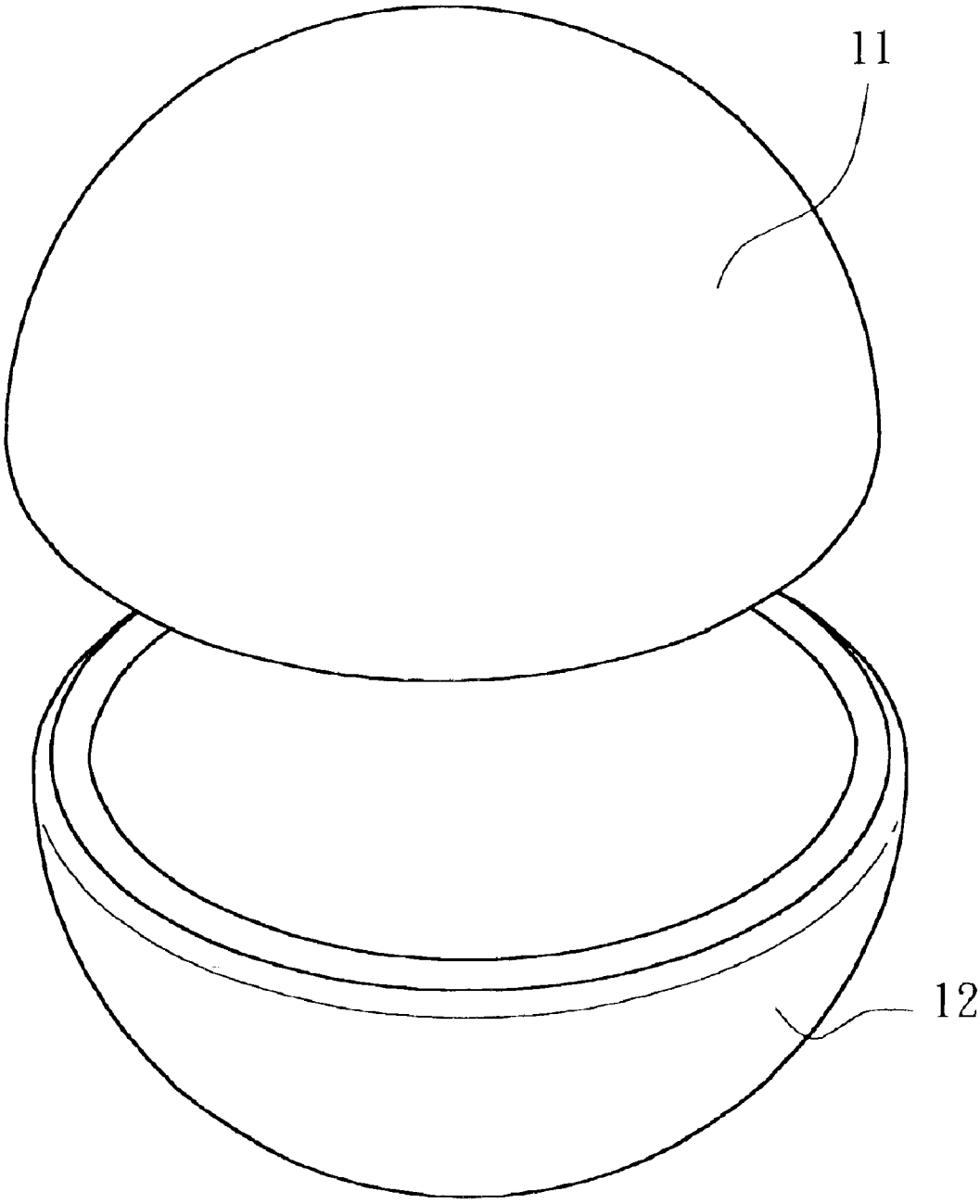
FIG. 3 is a perspective view of a core of the present invention.

Referring to the drawings and initially to FIGS. 1–4, a ball with a jigsaw cover in accordance with the present invention comprises a hollow core (10) and multiple puzzle pieces (20) detachably adhered to an outer periphery of the core (10).

The hollow core (10) comprises a first hemisphere (11) and a second hemisphere (12) connected to each other to formed a complete spheroid. The first hemisphere (11) and the second hemisphere (12) are made of metal board that has an ability of a magnetic conduction and has a suitable surface treatment to prevent the core (10) from being oxidized. The mating edge of the first hemisphere (13) is bent to form an annular lip (131) and the mating edge of the second hemisphere (14) is bent to form an annular groove (141). Consequently, the annular lip (131) is partially received in the annular groove (141) in the second hemisphere (14).

Each puzzle piece (20) has a first face abutting the outer periphery of the core (10) and a second face opposite to the first face of each of the puzzle piece (20). At least one magnet (21) is buried in each of the puzzle pieces (20) and has one side flush with the first face of each of the puzzle pieces (20). Consequently, each puzzle piece (20) can be adhered to the outer periphery of the core (10) due to the magnetic force of the magnet (21). For completely covering the outer periphery of the core (10) and forming a complete spheroid, each puzzle piece (20) has a curvature equal to that of the core (10). Each puzzle piece (20) has multiple parallel sections (22) each aligning with a corresponding one of the parallels of the core (10) and multiple meridian sections (23) each aligning with a corresponding one of the meridians of the core (10). The arranged parallel sections (22) and meridian sections (23) of each of the multiple puzzle pieces (20) define at least one concave portion (24) in each of the multiple puzzle pieces (20) and form at least one convex portion (25) laterally extending from each of the multiple puzzle pieces (20). The concave portion (24) is provided to receive a corresponding convex portion (25) of an adjacent puzzle piece (20) such that multiple puzzle pieces (20) are connected to one another. For a vivid appearance of the present invention, a pattern is provided to be printed on the second face of each of the puzzle pieces (20).

Figure 4:
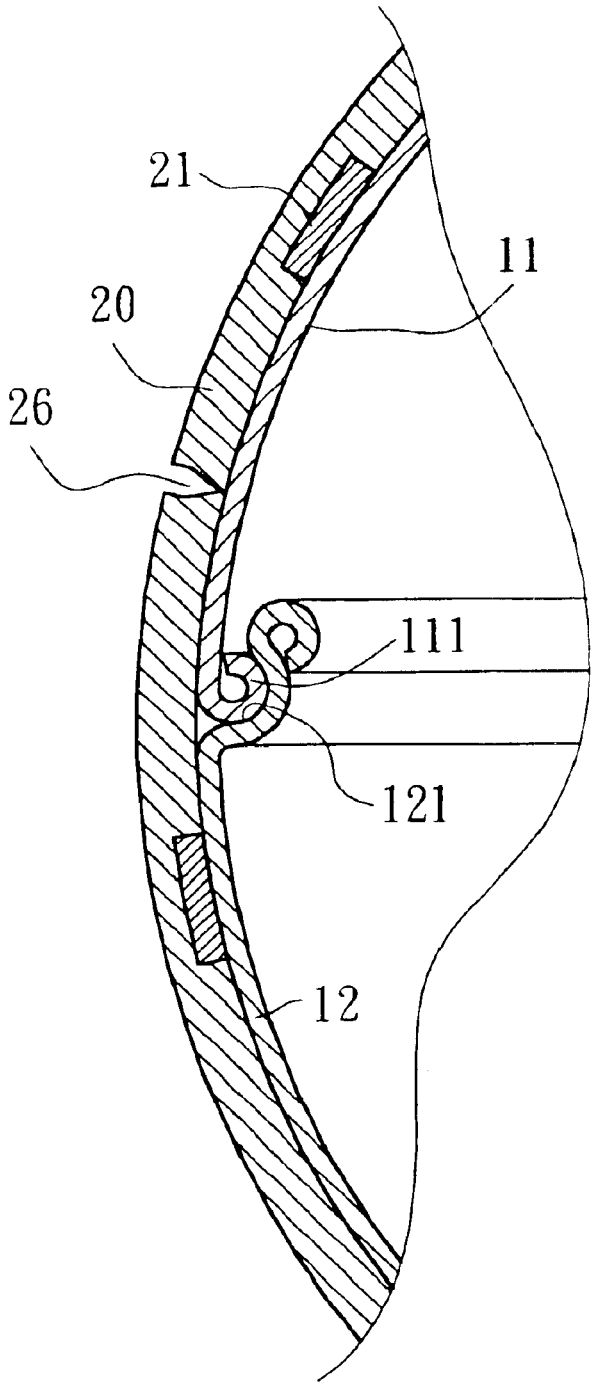
FIG. 4 is a partially cross-sectional view of the ball with a jigsaw cover in FIG. 1.

With reference to FIGS. 1 and 4, the present invention is provided to children such that the corners of each of the puzzle pieces (20) are slightly circled to prevent the user's skin from having an incised wound. The circled corners are based on safe misgivings. For easily detaching the multiple puzzle pieces (20) from the outer periphery of the core (10), the surrounding of each of the multiple puzzle pieces (20) is cut such that a notch (26) is defined between every two adjacent puzzle pieces (20), thereby the user can choose a suitable tool (not shown) inserted into the notch (26) to pry the puzzle piece (20) from the outer periphery of the core (10).

Figure 5:
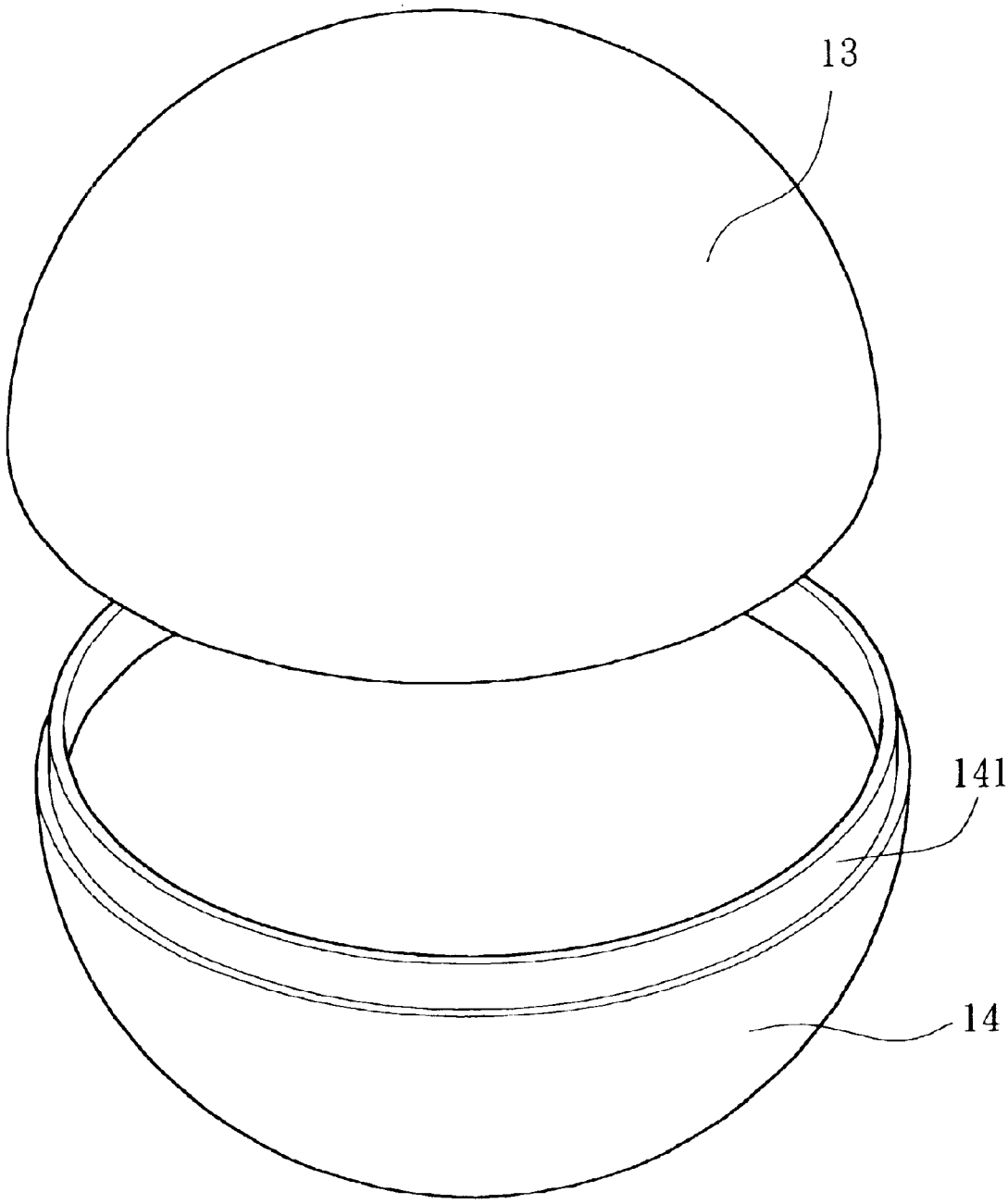
FIG. 5 is a perspective view of a second embodiment of the core in FIG. 3.
Figure 6:
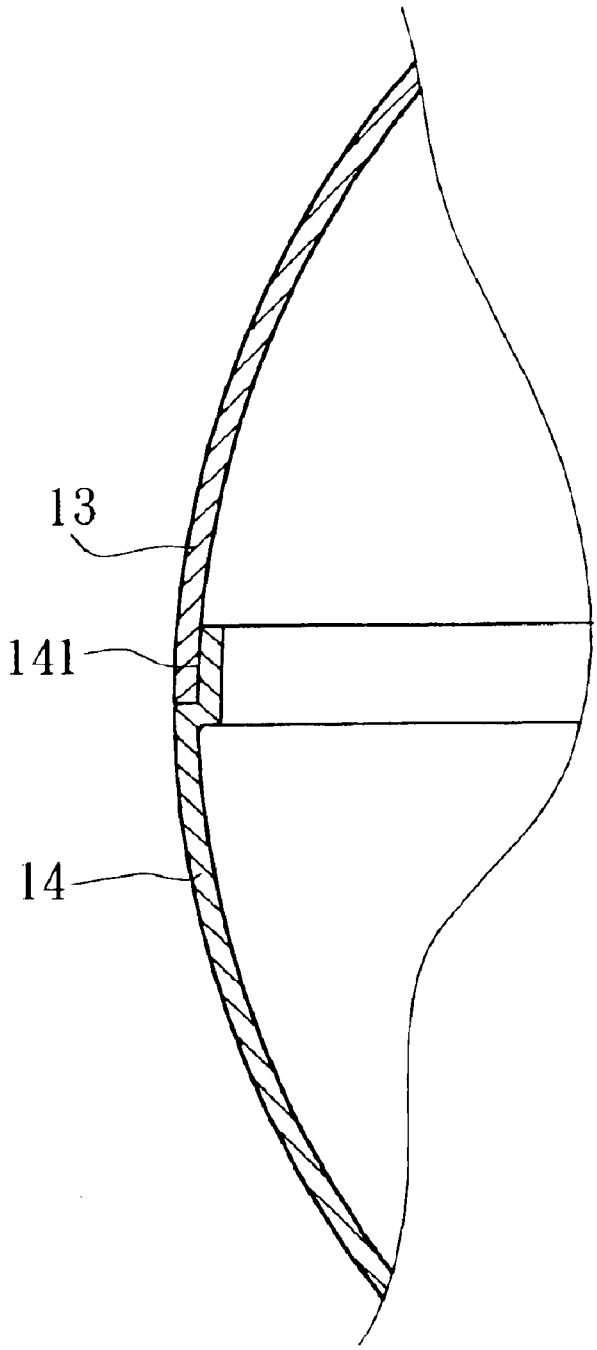
FIG. 6 is a partially cross-sectional view of the core in FIG. 5.
Figure 7:
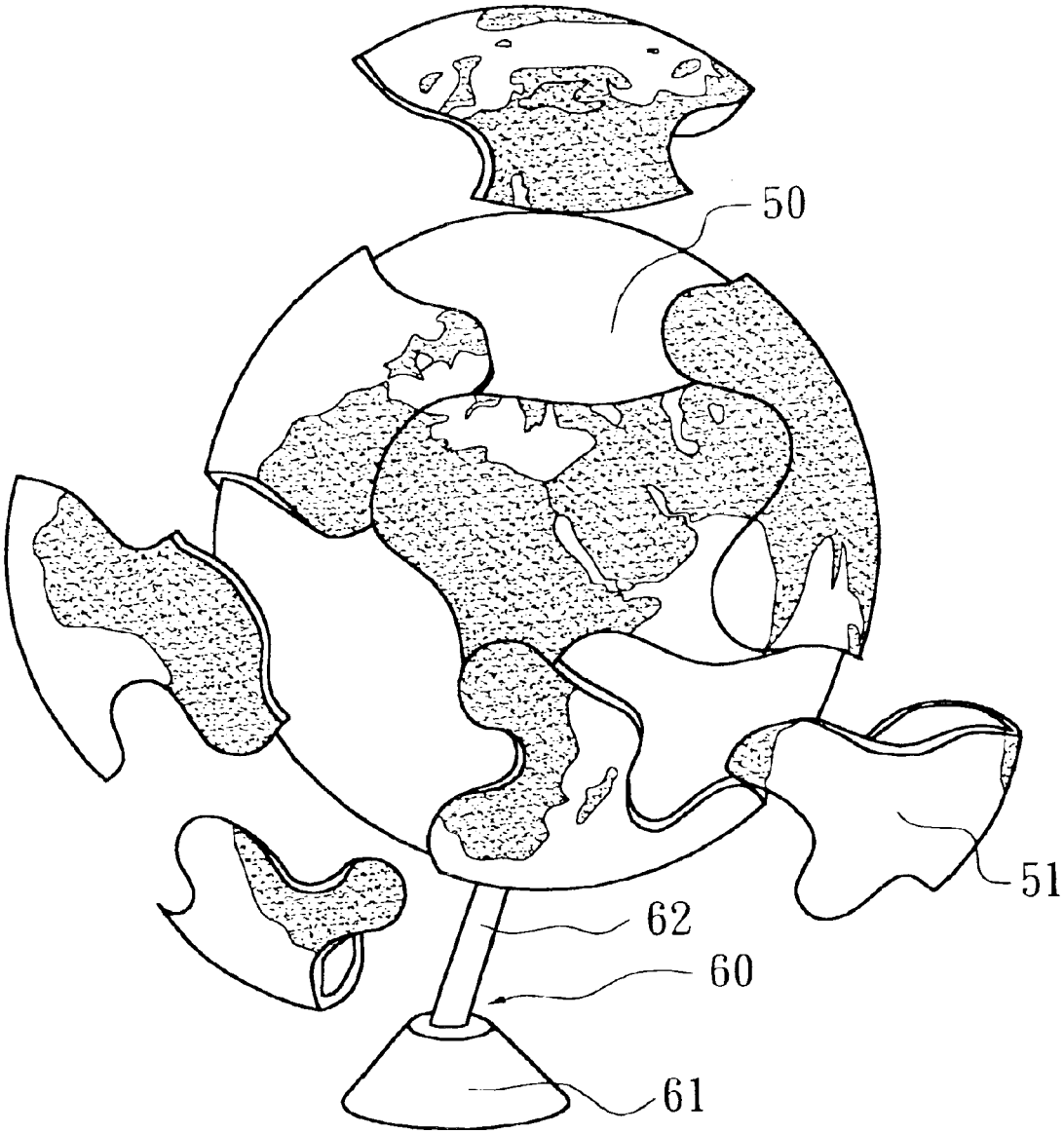
FIG. 7 PRIOR ART
FIG. 7 is a partially exploded view of an earth jigsaw puzzle in accordance with the prior art.

With reference to FIGS. 5 and 6 that show a second embodiment of the core (10) of the present invention. The core (10) includes a first hemisphere (13) and a second hemisphere (14) connected to each other to form a complete spheroid. The second hemisphere (14) has an annular groove (141) defined in a mating edge of the second hemisphere (14). The mating edge of the first hemisphere (13) is partially received in the annular groove (141) in the second hemisphere (14). The first hemisphere (13) and the second hemisphere (14) are welded together after the mating edge of the first hemisphere (13) being received in the annular groove (141) in the second hemisphere (14).

To piece together the multiple puzzle pieces (20) on the outer periphery of the core (10), all the puzzle pieces (20) is put on the outer periphery of the core (10) and connected to a corresponding one of the other puzzle pieces (20), and attached to the outer periphery of the core (10) due to the magnetic force of the magnet (21). After piecing together the multiple puzzle pieces (20), the magnetic force of the magnet (21) is strong enough to prevent the multiple puzzle pieces (20) from easily detaching from the outer periphery of the core (10) and each puzzle piece (20) is surrounded with others puzzle pieces (20). Consequently, the ball with jigsaw cover in accordance with the present invention not only provides a ball for children to play, but also provides amusements of jigsaw puzzle and functions of training logic ability when piecing together the multiple puzzle pieces (20).

As described above, in viewpoint of a ball, the ball with a jigsaw cover in accordance with the present invention provides amusements and interest that the conventional ball or jigsaw puzzle does not provide at the same time. The core (10) of the present invention is a complete spheroid that is combined with the first hemisphere (11) and the second hemisphere (12) and has a suitable surface treatment. Consequently, even the present invention without any puzzle piece (20) attached thereon, the core (10) still can be independently used as a ball for a younger child. When children gradually growing older, the jigsaw cover can further provides the amusements of jigsaw puzzle. However, the characteristic of a ball is retained, even though the puzzle pieces (20) are attached to the outer periphery of the core (10) and contrarily additionally provide amusements of jigsaw puzzle and functions of training logic ability. Consequently, the using range of age is widened and the cost of buying toy for a child is reduced.

Although the invention has been explained in relation to its preferred embodiment, it is to be understood that many other possible modifications and variations can be made without departing from the spirit and scope of the invention as hereinafter claimed.

What is claimed is:

1. A ball with a jigsaw cover comprising:

a hollow core including a first hemisphere and a second hemisphere fixedly connected to each other to form a complete spheroid; and multiple puzzle pieces detachably adhered to an outer periphery of the hollow core, each puzzle piece having a curvature equal to that of the hollow core for completely covering the outer periphery of the hollow core and forming a complete spheroid, each puzzle piece including multiple parallel sections each aligning a corresponding one of the parallels of the hollow core and multiple meridian sections each aligning with a corresponding one of the meridians of the hollow core, the parallel sections and the meridian sections of each of the multiple puzzle pieces defining at least one concave portion in each of the multiple puzzle pieces and forming at least one convex portion laterally extending from each of the multiple puzzle pieces, each concave portion provided to receive a corresponding convex portion of an adjacent puzzle such that the multiple pieces are connected to one another to completely cover the hollow core.

2. The ball with a jigsaw cover as claimed in claim 1, wherein the first hemisphere includes a mating edge bent to form an annular lip and the second hemisphere includes a mating edge bent to define an annular, the annular lip of the first hemisphere partially received in the annular groove in the second hemisphere when the first hemisphere and the second hemisphere are connected to each other.

3. The ball with a jigsaw as claimed in claim 1, wherein the first hemisphere and the second hemisphere are made of metal board that has an ability of a magnetic conduction and each has a surface treatment to prevent the hollow core from being oxidized, and each puzzle piece includes at least one magnet buried therein and having one side facing the outer periphery of the hollow core such that each puzzle piece can be adhered to the outer periphery of the hollow core due to the magnetic force of the at least one magnet in each of the puzzle piece.

4. The ball with a jigsaw as claimed in claim 1, wherein the first hemisphere and the second hemisphere are made of metal board that has an ability of a magnetic conduction and each has a surface treatment to prevent the hollow core from being oxidized, and each puzzle piece includes at least one magnet buried therein and having one side facing the outer periphery of the hollow core such that each puzzle piece can be adhered to the outer periphery of the hollow core due to the magnetic force of the at least one magnet in each of the puzzle piece.

* * * * *